US008434179B2

(12) United States Patent
Reeves et al.

(10) Patent No.: US 8,434,179 B2
(45) Date of Patent: May 7, 2013

(54) BREATHABLE INFANT BEDDING

(76) Inventors: Whitney Reeves, Brunswick, ME (US); Seabren Reeves, Brunswick, ME (US)

( * ) Notice: Subject to any disclaimer, the term of this patent is extended or adjusted under 35 U.S.C. 154(b) by 0 days.

(21) Appl. No.: 13/580,096

(22) PCT Filed: Sep. 2, 2011

(86) PCT No.: PCT/US2011/050319

§ 371 (c)(1),
(2), (4) Date: Aug. 20, 2012

(87) PCT Pub. No.: WO2012/031195

PCT Pub. Date: Mar. 8, 2012

(65) Prior Publication Data

US 2012/0311792 A1 Dec. 13, 2012

Related U.S. Application Data

(60) Provisional application No. 61/402,696, filed on Sep. 3, 2010, provisional application No. 61/499,781, filed on Jun. 22, 2011.

(51) Int. Cl.
*A47C 31/00* (2006.01)
*A47C 17/00* (2006.01)

(52) U.S. Cl.
USPC ..... 5/946; 5/663; 5/724

(58) Field of Classification Search ..... 5/724, 98.1, 5/946, 663, 93.1, 424, 425; 297/7–12
See application file for complete search history.

(56) References Cited

U.S. PATENT DOCUMENTS

| | | | | | |
|---|---|---|---|---|---|
| 2,718,014 | A * | 9/1955 | Mizrach et al. | 4/506 |
| 3,513,489 | A * | 5/1970 | Martin et al. | 5/98.1 |
| 3,619,824 | A * | 11/1971 | Doyle | 5/143 |
| 5,010,611 | A * | 4/1991 | Mallett | 5/497 |
| 5,035,014 | A * | 7/1991 | Blanchard | 5/424 |
| 5,367,730 | A * | 11/1994 | Sher | 5/655 |
| 5,881,408 | A | 3/1999 | Bashista et al. | |
| 5,937,458 | A * | 8/1999 | DeRosa | 5/424 |
| 5,960,493 | A * | 10/1999 | Rhey et al. | 5/424 |
| 6,055,690 | A * | 5/2000 | Koenig | 5/724 |
| 6,721,974 | B1 * | 4/2004 | Wilkinson | 5/425 |
| 7,055,192 | B2 | 6/2006 | Waters | |
| 7,614,098 | B1 * | 11/2009 | Quarry | 5/111 |
| 2010/0107338 | A1 * | 5/2010 | Waters et al. | 5/502 |
| 2010/0275379 | A1 | 11/2010 | Streightiff | |
| 2012/0317721 | A1 * | 12/2012 | Dunne et al. | 5/424 |

FOREIGN PATENT DOCUMENTS

| | | | |
|---|---|---|---|
| GB | 2201589 | A * | 9/1988 |
| JP | 2005-046608 | A | 2/2005 |
| JP | 2008-110194 | A | 5/2008 |

* cited by examiner

*Primary Examiner* — Robert G Santos
*Assistant Examiner* — Myles Throop
(74) *Attorney, Agent, or Firm* — Patricia M. Mathers

(57) ABSTRACT

The breathable bedding described here serves to protect an infant from suffocating due to close contact with bedding. The breathable bedding includes one or more breathable bedding elements, which are made of a material that allows air to pass through it freely, is flexible, yet has sufficient stiffness to hold a three-dimensional shape. The three-dimensional shape ensures a cushioning effect. The breathable bedding elements are covered with a breathable fabric, such as a light woven or open-weave fabric, to form a breathable bedding panel that may serve as a crib bumper or mattress.

12 Claims, 6 Drawing Sheets

| Test | Pressure (cm $H_2O$) |
|---|---|
| Test 1 | 1.79 |
| Test 2 | 1.73 |
| Test 3 | 1.67 |
| Test 4 | 1.70 |
| Test 5 | 1.70 |
| Test 6 | 1.73 |
| Test 7 | 1.66 |
| Test 8 | 1.69 |
| Test 9 | 1.71 |
| Test 10 | 1.73 |
| Test 11 | 1.86 |
| Test 12 | 1.89 |
| Test 13 | 1.92 |
| Test 14 | 1.93 |
| Test 15 | 1.88 |
| Test 16 | 1.92 |
| Test 17 | 1.87 |
| Test 18 | 1.91 |
| Test 19 | 1.84 |
| Test 20 | 1.82 |
| Test 21 | 1.90 |
| Test 22 | 1.89 |
| Test 23 | 1.87 |
| Test 24 | 1.84 |
| Test 25 | 1.83 |
| Test 26 | 1.85 |
| Test 27 | 1.86 |
| Test 28 | 1.83 |
| Test 29 | 1.87 |
| Test 30 | 1.91 |
| Maximum | 1.93 |

FIG. 12

BREATHABLE INFANT BEDDING

BACKGROUND INFORMATION

1. Field of the Invention

The present invention relates to bedding for a baby crib. More particularly, the invention relates to mattress, crib bumpers, and support and carry devices for infants.

2. Discussion of the Prior Art

Newborns and very young infants have limited mobility and because of that, can maneuver themselves into hazardous situations, yet not be able to move away from the hazard. Suffocation, particularly, is a serious hazard for infants. The infant's face may become pressed or lodged against a mattress or crib bumper and either suffocate because he or she can't breathe or because of re-breathing CO2 that is trapped between the infant's face and the mattress or bumper. Mattresses for infants are typically made of a thick polyvinyl or polyurethane foam material that provides a cushioned surface for the infant to sleep on. The foam material does not allow sufficient air to pass through it, that would prevent the infant from suffocating.

Crib bumpers have become a standard bedding accessory for baby cribs, primarily for safety reasons. The walls or side rails of the conventional baby crib are typically formed by vertical slats with open spaces between them. Infants can injure themselves by getting an arm or a leg caught between the slats. One common way of avoiding such injuries is to fit the crib walls with crib bumpers. One type of conventional crib bumper is a cushion that extends the length of a crib wall and is fastened to the crib slats with ties. The cushion is filled with a foam material or polyester fill, so the bumper is soft and also machine washable. As with the mattress, the padding in the bumper that is necessary to provide the desired cushioning effect also blocks a flow of air through it and, as a result, the infant is at risk of suffocation, should her face become lodged against the bumper. A further disadvantage of the conventional crib bumper is that, because it is a pad, it inherently provides a certain resistance to compression. As a result, an infant may stand on the bumper, in order to raise herself up so that she is able to clamber over the top of the crib wall.

Another type of conventional crib bumper is made of a mesh material that allows ventilation through it, thereby reducing the risk of suffocation, should an infant's face become lodged against it. Typically, the mesh material is thin, so, although it does prevent the infant from extending an arm or a leg between slats, it does not provide the desired cushioning effect, should the infant roll or fall against the crib wall.

Yet another type of crib bumper is a pad that is wrapped about the individual wall slats. This type of bumper reduces the risk of suffocation mentioned above, but it doesn't prevent the infant from pushing an arm or a leg through the space. Furthermore, this type of bumper is much more time consuming to install, in that each vertical slat has to be wrapped. It also requires significantly more material and more labor to manufacture and, thus, is costly, relative to the bumpers that extend along an entire crib wall and are fastened with ties in a couple of locations to the crib wall.

What is needed, therefore, is bedding for a baby crib that eliminates the risk of suffocation and yet provides the desired cushioning effect. What is further needed is a crib bumper that cannot serve as a means of elevation, should an infant try to clamber over the crib wall. What is yet further needed is such bedding that can be laundered and is also economical to manufacture.

BRIEF SUMMARY OF THE INVENTION

The invention is bedding that provides breathability and serves as a mattress, a cushion against the vertical slats of a crib wall, or other type of infant support, bedding, or enclosure. The word "bedding" as used herein, is understood to encompass any device that is used as a sleep or recreational support, enclosure, or carrier for infants. Examples of such bedding includes, but without limitation, a mattress, crib bumper, crib, basinette, playpen, carrier, etc. The bedding according to the invention significantly reduces the risk of suffocation and has an additional advantage, in that it provides a cushioning effect against a force applied in one direction, yet collapses when force is applied in another direction. This structural feature makes the bedding useful as material for a mattress or mattress pad to provide a cushioned support for an infant, as well as for a crib bumper. Should an infant stand on a crib bumper according to the invention in order to lift herself to position that will enable her to climb over the crib wall, the bumper will collapse.

The common element for the breathable bedding according to the invention is a cushion or bumper element, that is used to construct a breathable bedding panel that can then be used as a mattress, a mattress pad, crib bumper, etc. For ease of description, and regardless of the intended use of the bedding according to the invention, whether it be as a mattress, a crib bumper, or other type of cushioning or supporting device, the element shall be generally referred to hereinafter as a "breathable bedding element," and a configuration of two or more breathable bedding elements assembled to form a panel, as a "breathable bedding panel."

The breathable bedding element is constructed of a mesh material that is flexible, yet has some stiffness to it. The mesh material is used to form a flat, i.e., essentially two-dimensional, back wall and a front wall that is affixed to the upper and lower edges of this back wall such that the front wall bulges away from the back wall. Looking directly at an end of the element, the shape looks similar to the letter "D". The mesh material ensures good ventilation. The three-dimensional structure of the breathable bedding element provides a desired cushioning effect, such that it is very suitable for various types of bedding, yet provides a desired degree of compressibility when the element is installed as a crib bumper. The bulge of the front wall resists a horizontal compression force that is applied perpendicular to the plane of the back wall, providing the cushioning, yet pre-biases the element to fold or collapse when a vertical compression force is applied in a direction approximately parallel to the vertical back wall.

The breathable bedding panel may have a cover or enclosure that encases the one or more breathable bedding elements that form a panel, or may not, depending on the intended use.

BRIEF DESCRIPTION OF THE DRAWINGS

The present invention is described with reference to the accompanying drawings. In the drawings, like reference numbers indicate identical or functionally similar elements. The drawings are not drawn to scale.

FIG. 12 shows the results of the suffocation hazard tests.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
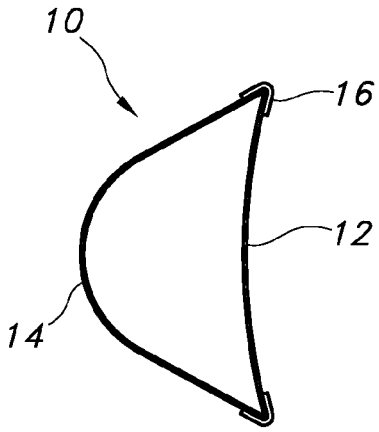
FIG. 1 is a side view of a breathable bedding element according to the invention, showing the shape of the element.
Figure 2:
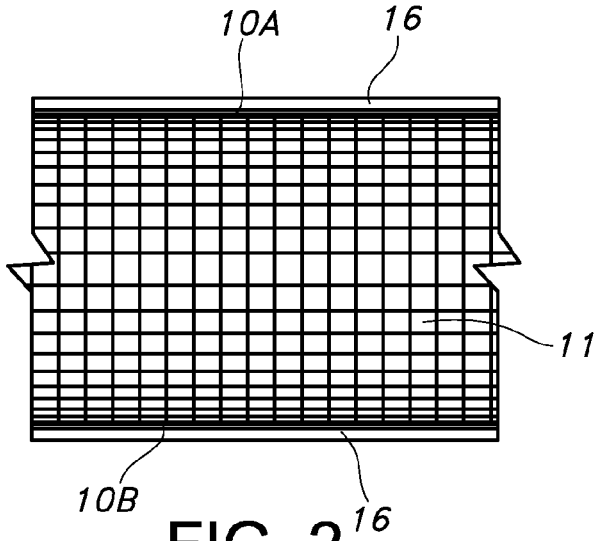
FIG. 2 is a front view of the breathable bedding element of FIG. 1.

FIGS. 1 and 2 illustrate a breathable bedding element 10 according to the invention. One or more breathable bedding elements 10 may be used to construct a breathable bedding panel 100 according to the invention.

The breathable bedding element 10 has a back wall 12 and a front wall 14, each wall constructed of an initially flat sheet of fabric. The walls 12 and 14 are affixed to each other at an upper end 10A and a lower end 10B. In the embodiment shown, a fabric tape 16 is stitched or adhesively applied along the upper 10A and lower 10B edges, enclosing the edges of both walls within the tape. Depending on the material used or on the intended use, it may not be necessary to enclose the edges in tape or fabric. Rather, it may be suitable to simply fuse, glue, or stitch the edges together. The height dimension of the fabric for the front wall 14 is greater than that of the back wall 12, such that when the respective upper 10A and lower 10B edges of the two walls are joined, the breathable bedding element 10 takes on a three-dimensional structure that is similar to a "D", as shown in FIG. 1.

For purposes of description, the breathable bedding panel and the breathable bedding element will be described in terms relative to their position when the breathable bedding panel is used to support or cushion an infant. Thus, "front" wall or surface is the curved portion of the D-shaped element; "rear" wall or surface is the straight side of the D-shaped element; "side" refers to the ends of the panel or element. "Thickness" refers to the depth dimension of the breathable bedding element measured at the greatest distance of the front wall from the rear wall. Because the thickness of a fabric is generally very small relative to its width and length dimensions, fabric is often referred to as a flat or two-dimensional structure. For reasons of simplicity and clarity, the term "three-dimensional shape" (or "structure") used hereinafter shall refer to a structure formed of two layers of fabric, whereby the overall height or depth of the structure is substantially greater than the thickness of the two layers of fabric.

The material used for the breathable bedding element according to the invention is a plastic mesh fabric or perforated plastic sheet, such as is frequently used in making latch hook rugs. One such commercially available material is a plastic canvas that is manufactured by Darice, Inc. of Strongsville, Ohio. This material has sufficient stiffness for the breathable bedding element to maintain its three-dimensional shape, so that the breathable bedding element provides resistance to compression in a direction perpendicular to the back wall, which provides the cushioning effect. At the same time, the structure provides little resistance to compression when a force is applied in the vertical direction, i.e., in a direction approximately parallel to the back wall, and reverts to its original shape when the force is removed. As a result, the breathable bedding element according to the invention collapses easily if an infant stands on it. Other suitable materials may also be used, as long as the material is a mesh or open-weave material that will allow air to pass through it easily and also has sufficient stiffness to maintain a three-dimensional shape and dual functions described above.

Figure 3A:
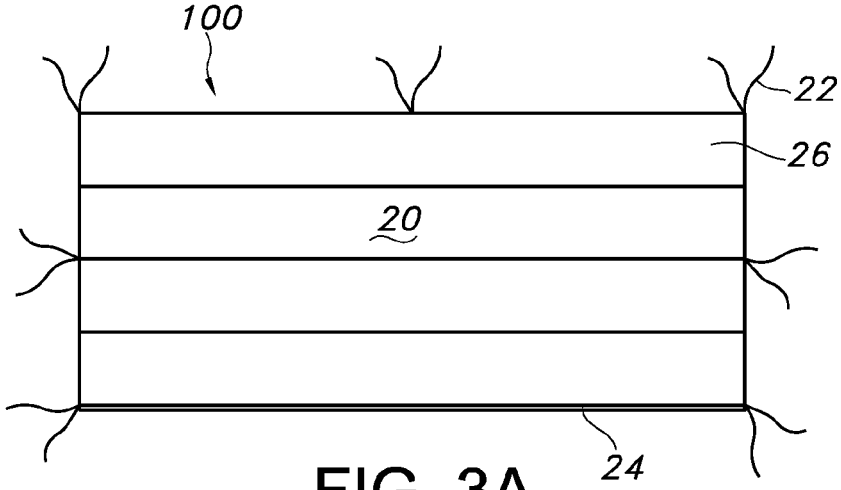
FIG. 3 is a front plane view of the crib bumper according to the invention, showing a panel with four breathable bedding elements.
Figure 3B:
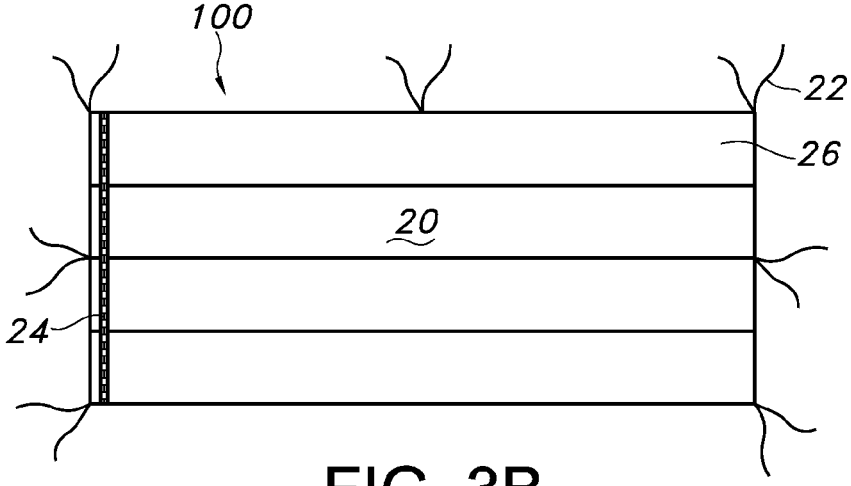
Figure 4:
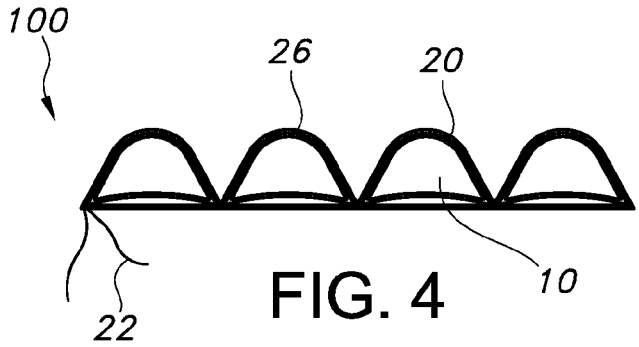
FIG. 4 is a side elevation view of the crib bumper of FIG. 3.
Figure 5:
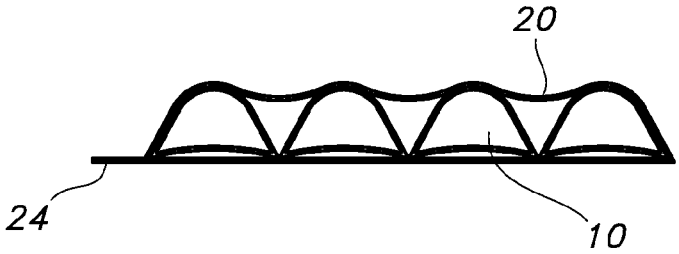
FIG. 5 is a side view of a second embodiment of the crib bumper according to the invention.

FIGS. 3A-5 show the breathable bedding panel 100 according to the invention, comprising a plurality of breathable bedding elements 10 arranged in adjacent rows, a cover 20 with attachment means 22 and closure means 24. The cover 20 has a one or more pockets 26. The embodiment shown in FIGS. 3A and 3B is that of a crib bumper, but it is understood, that this construction of the breathable bedding panel 100 is also suitable for a mattress, a mattress pad, or a play mat, with or without fastening means. The cover 20 is constructed to have four individual pockets 26, into each of which a breathable bedding element 10 is inserted. It is within the scope of the invention, however, to have a cover 20 that provides a single large pocket 26, whereby the various breathable bedding elements 10 are stitched together to form a single unit that is slid into the cover, as shown in FIG. 5. The breathable bedding element 10 is not limited to a specific number of breathable bedding elements 10, nor to specific dimensions. Thus, the breathable bedding panel 100 may be provided in different sizes, i.e., in various widths and thicknesses, and with one, two, three, four, five, or more breathable bedding elements 10. It is also within the scope of the invention to provide a breathable bedding panel 100 that is without the cover 20. This may be desirable for a mattress pad cover, for example, which would then be covered by a conventional sheet made of a breathable fabric, such as a thin cotton sheet. In this case, the breathable bedding elements are fastened together to obtain the mat.

The breathable bedding element 10 and breathable bedding panel 100 allow an infant to breathe through it, thereby reducing the risk of an infant whose face has become pressed or lodged against the panel from suffocating. For this reason, it is suggested that the cover 20 be made of a material that does not impede breathability and preferably, of a fabric that can be laundered. Light woven or open-weave fabrics, such as, for example, cotton, silk, polyester, and nylon, mesh fabrics, and some knitted fabrics are suitable fabrics. It is conceivable, however, that the breathable bedding panel 100 be used in situations in which breathability is not an issue, but in which the dual function of cushioning and collapsing is desirable. In this case, the material for the cover 20 may be any fabric suitable for the intended purpose.

The breathable bedding panel 100 shown in FIG. 5 has a closure 24 along one edge. The closure 24 is shown along the lower edge of the panel 100, but it can just as well be provided along the top or along the rear wall of the cover, whichever is most convenient for the particular use. For the embodiment shown in FIG. 4, in which individual pockets 26 are provided for the elements 10, the closure 24 is provided along the back wall 12, extending from an upper edge to a lower edge of the bumper 100, and preferably close to one of the side edges of the bumper, so as to allow a breathable bedding element 10 to be inserted into each pocket 26. In either case, the closure may be a zipper, a flap of fabric that tucks into the cover, a hook-and-loop fabric fastener stitched to the open edges of the cover, snaps, buttons and buttonholes, etc.

Depending on the use of the breathable bedding panel 100, attachment means 22 may be provided. If used as a crib bumper, for example, ties may be stitched to the cover 20 at several locations. Other suitable attachment means 22 may also be used, such as hooks, elastic straps with hooks or buckles, hook-and-loop fabric strips, fabric tabs that wrap around a corner post of the crib, a vertical slat on the crib wall, or around the upper bar of the crib wall and that are secured with buttons and button holes, snaps, buckles, etc. If the breathable bedding panel 100 is used as a mattress pad, elastic bands may be attached diagonally across two or more of the four corners, for securing it to the mattress or it may have no attachment means at all.

Figure 6:
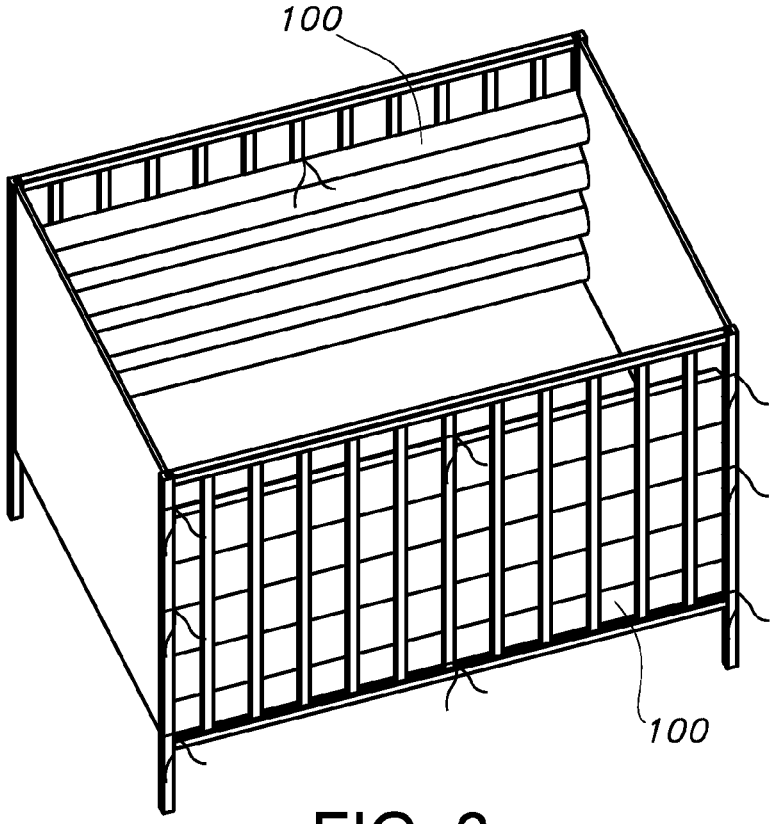
FIG. 6 is a perspective view of a crib with the crib bumper according to the invention fastened to two crib walls.

FIG. 6 shows two breathable bedding panels 100 fastened to two walls of a crib, to serve as a breathable crib bumper. It is understood, that the breathable bedding panel may be attached to all of the walls. The breathable bedding panel 100 may also be used on a playpen or other enclosure for which a bumper with a cushioning effect is desired.

Figure 8:
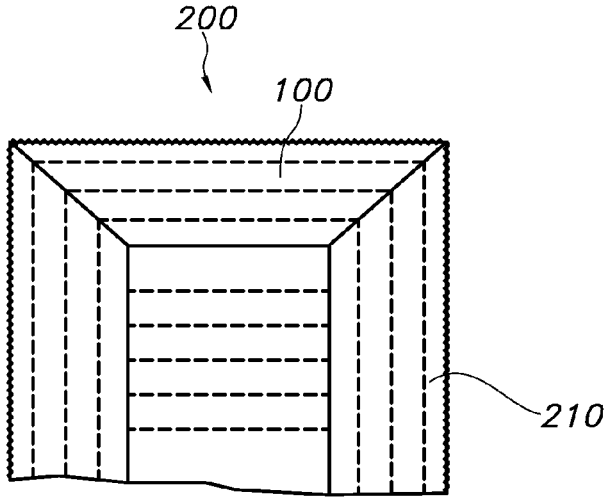
FIG. 8 illustrates a nesting pillow constructed of the breathable bedding elements.
Figure 7:
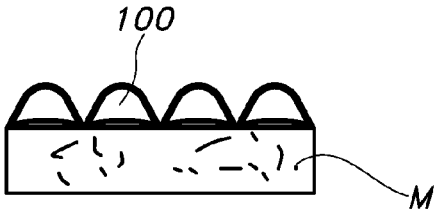
FIG. 7 illustrates a mattress with mattress pad constructed of the breathable bedding elements.
Figure 9:
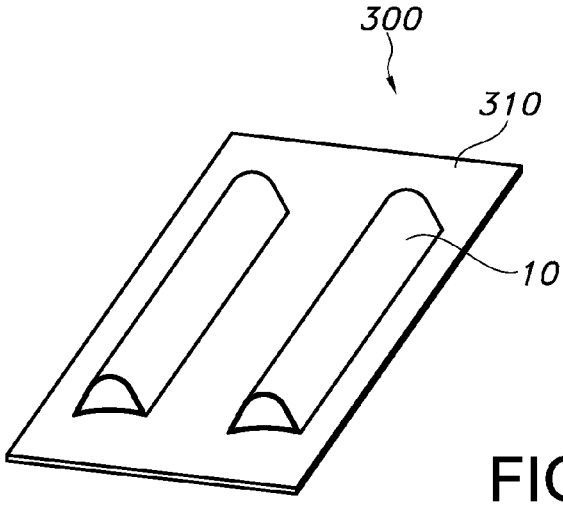
FIG. 9 illustrates a sleep wedge for positioning a baby for sleep.

FIG. 7 is a schematic cross-sectional view of a conventional mattress M, with a breathable bedding panel 100 placed over the mattress. FIG. 8 illustrates a "nest" or sleep support cushion 200 that is constructed of a plurality of breathable bedding panels 100. In this embodiment a plurality of breathable bedding elements are inserted into a sleep support cover 210 along a back section and two side sections to form a three-walled enclosure. The bottom of the nest 200 may be open or may be closed, or may also be fitted the breathable bedding panels 100. FIG. 9 illustrates a sleep wedge 300 which may be used to position the infant in a safe and comfortable position for sleeping. The wedge has a flat or angled support surface 310 with a breathable bedding element inserted into a pocket that is placed along each side of the support surface. The pockets are spaced apart to accommodate the size of the infant and to prevent the infant from rolling over. The support surface may be a cotton or other woven, absorbent fabric, or may also include the breathable bedding panel 100 according to the invention. The sleep wedge 300 may be provided in various sizes to accommodate infants of various ages.

Figure 10:
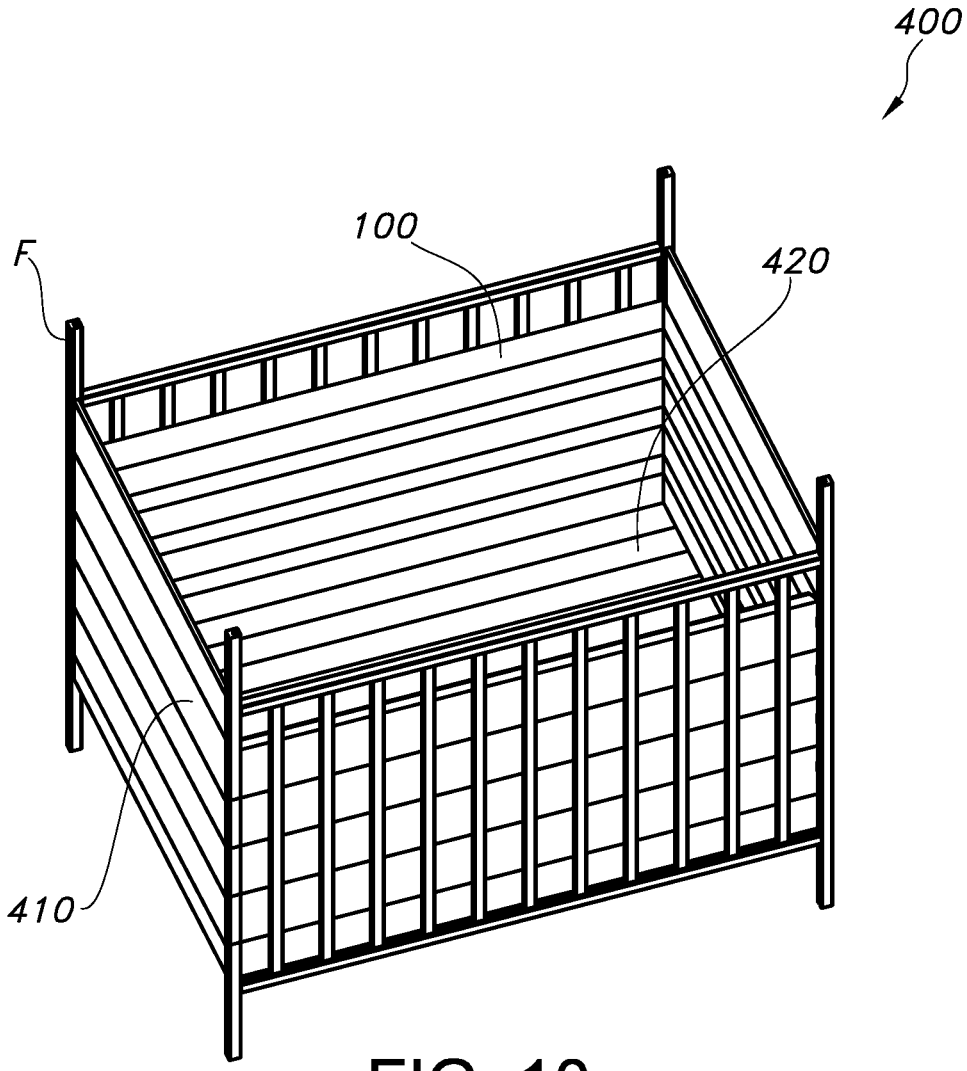
FIG. 10 illustrates portable crib, constructed of the breathable bedding elements.

FIG. 10 illustrates a crib 400 having a rigid frame F and crib walls 410 and a mattress 420 constructed of the breathable bedding panel 100. The crib 400 may be designed to be portable, with the walls 410 readily detachable from the frame 420 and the frame being collapsible. It is well known to construct a collapsible frame and the attach detachable walls or panels to a frame. Thus, it is not necessary to describe these features with any detail.

It is understood that the inventive devices are the breathable bedding element 10 and a panel 100 constructed of two or more breathable bedding panels 10. These elements may used individually or in combination with a plurality of elements or in combination with other materials and structures to form myriad devices, with at least a breathable surface. The breathable bedding panel according to the invention may also be provided as a retrofit kit, to fit out an already existing infant carrier or support, car seat or other type of support or bedding. The scope of the invention is not limited to a particular type of device or shape of device.

The breathable bedding panel 100 was evaluated by a recognized laboratory test facility, Intertek, Risk Assessment and Management, of Oak Brook, Ill., with regard to potential risks of a baby re-breathing carbon dioxide or suffocating and the results presented in Intertek Technical Report No. WOUS07491, "Carbon Dioxide Rebreathing and Suffocation Hazard Assessments for the Bitzy Bumper," Jul. 19, 2011, the contents of which are included herein in its entirety. The risk of carbon-dioxide-rebreathing, i.e., breathing in exhaled air, was assessed, using a breathable bedding panel 100 having three breathable bedding elements 10 arranged similarly to the embodiment shown in FIG. 3B and covered with a cotton cover that included individual pockets for the breathable bedding elements, as shown in FIG. 4. This breathable bedding panel is referred to in the Intertek report as the "Bitzy Bumper."

The potential of the breathable bedding panel of the present application to retain carbon dioxide (CO2) that can then be breathed in by a baby was compared to the potential risks of products with known hazard levels. Sheepskin and cushions filled with polystyrene beans or pellets (beanbag) represent products that are associated with a high hazard for re-breathing CO2, whereas a firm mattress covered with a cotton sheet represents a low hazard. The presence of CO2 was evaluated within the product itself, in an area that would be in close proximity to the oral and nasal passages of an infant. A mannequin representing an approximately one-month old infant was used as the interface to evaluate the breathable bedding panel and was positioned so that the nose and mouth were placed directly against the breathable bedding panel, the firm mattress, the sheepskin, and the beanbag, respectively. Equipment was used to simulate the typical breathing pattern of an infant. A microprocessor collected sensor data and calculated various real-time parameters that included instantaneous CO2 concentration, respiration rate, end-tidal CO2, inspired CO2, and inspiration and expiration times.

Figure 11:
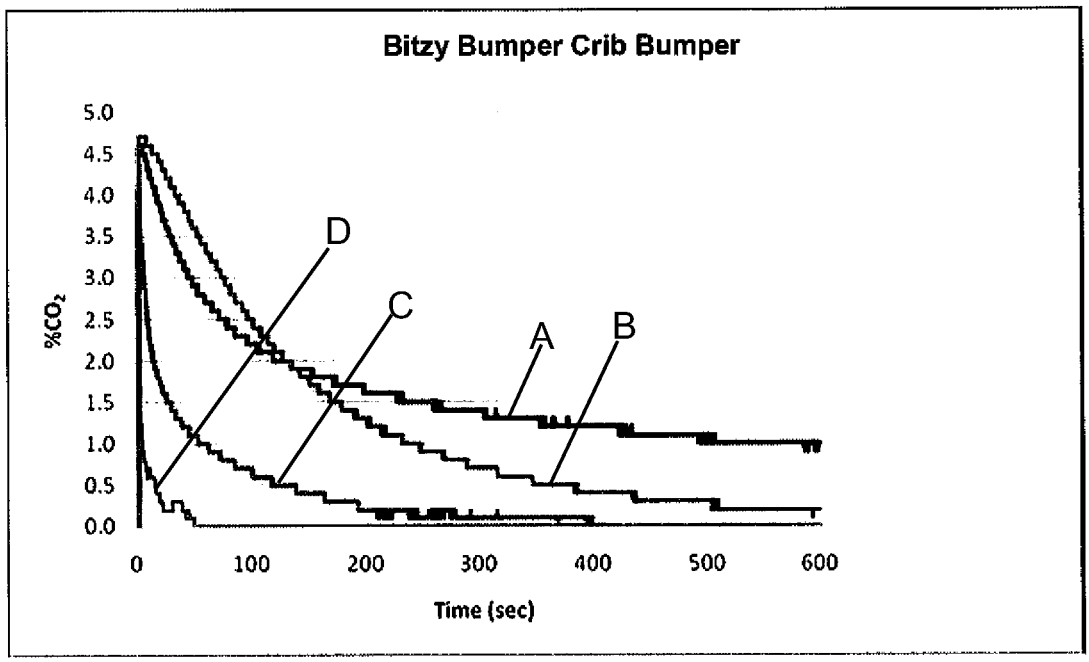
FIG. 11 shows the results of the carbon dioxide rebreathing tests performed on various products.

FIG. 11 and Table 1 show the carbon dioxide rebreathing test results that were obtained for four different product samples: a beanbag A, a sheepskin B, a firm mattress C, and the breathable bedding panel D according to the invention. The area under each curve represents the amount of CO2 that was retained by the particular sample. As can be seen, the curve for the breathable bedding panel D is significantly lower than the next lowest product, the firm mattress C. Compared to the firm mattress C, the beanbag presents a hazard that is 4.95 times greater than that of the mattress, and the breathable bedding panel D a hazard 0.095 times smaller than that of the mattress. In other words, the carbon dioxide rebreathing test results show that the breathable bedding panel has a risk value of less than 1/10 the risk of the firm mattress with the cotton sheet. The breathable bedding panel according to the invention, when covered in a cotton breathable material, presents an extremely low carbon dioxide rebreathing hazard.

TABLE 1

Carbon Dioxide Rebreathing Results

| Sample Description | Scenario Description | Area under Curve (% CO2-sec) |
|---|---|---|
| Bean Bag | High Hazard Comparator | 977.58 |
| Long Sheepskin | High Hazard Comparator | 739.77 |
| Thin Mattress | High Hazard Comparator | 197.33 |
| Bitzy Bumper | Test Sample | 18.70 |

Also assessed was the risk of suffocation, when a baby's face is pushed up against or into the breathable bedding panel, the panel being the same "Bitzy Bumper" as was used in the carbon dioxide rebreathing test. Suffocation due to asphyxia is caused by a mechanical barrier to breathing, i.e., caused by an object that conforms to the contour of the face and is in direct contact with the infant's mouth and nose. Again, a mannequin representing a one-month old infant was used, and a mechanical lung system was employed to simulate infant breathing. The breathable bedding panel 100 was used as the mechanical barrier and was placed proximate to the face of the mannequin. The peak pressure inside the mechanical lung was measured, to determine if breathing could be sustained through the bumper. The recommended upper limit for peak pressure, under which an infant is deemed capable of breathing for a reasonable amount of time, is 15 cm of water (H2O). The lower the pressure, the easier it is for the infant to breathe and the longer the infant can sustain breathing. FIG. 12 shows the suffocation hazard test results for the bumper. Thirty tests measuring the highest peak pressure were carried out. The degree to which the highest peak pressure of a product exceeds the USL is an indication of a potential airway obstruction hazard that exists with the product. The highest peak pressure measured with the Bitzy Bumper was 1.93 cm H2O, a result that is significantly lower than the upper specification limit (USL) of 15 cm H2O. These results document that the "Bitzy Bumper", i.e., the breathable bedding panel described above presents an extremely low suffocation hazard.

Finally, a statistical analysis to determine the Z-value of the product was done, based on the results of the suffocation hazard test. Z-value is a statistical measurement that describes and predicts product performance. The industry standard Z-value for baby products is 4, and the higher the Z-value, the lower the risk. The Z-value is defined as:

$$Z = \frac{USL - \overline{X}}{s}$$

$$\text{Where, } \overline{X} = \frac{\sum_{i=1}^{n} X_i}{n} \quad s = \sqrt{\frac{\sum_{i=1}^{n} (X_i - \overline{X})^2}{n-1}}$$

The Z-value for the Bitzy Bumper was determined to be 118.94, which represents a suffocation hazard 30 times smaller than the industry standard.

It is understood that the embodiments described herein are merely illustrative of the present invention. Variations in the construction of the breathable bedding panel and in its uses may be contemplated by one skilled in the art without limiting the intended scope of the invention herein disclosed and as defined by the following claims.

What is claimed is:

1. A three-dimensional, breathable bedding element comprising:

a front wall sheet and a rear wall sheet, each sheet constructed of a material that is stiffly flexible and that allows air to pass therethrough freely, each sheet having a length dimension and a height dimension, the back sheet having an upper back wall edge and a lower back wall edge and the front sheet having an upper front wall edge and a lower front wall edge;

wherein the upper back wall edge and upper front wall edge are affixed to each other and the lower back wall edge and the lower front wall edge are affixed to each other and wherein the height dimension of the front wall sheet is greater than the height dimension of the back wall sheet, such that the front wall and back wall together form a three-dimensional shape;

wherein the three-dimensional shape provides a first resistance against a force applied in a direction transverse to a vertical plane of the back wall and a second resistance against a force is applied in a direction parallel to the back wall, the first resistance being greater than the second resistance and providing a cushioning effect, the second resistance allowing the three-dimensional shape to flatten.

2. The breathable bedding element of claim 1, wherein the material for the front wall and back wall is a mesh material that is flexible, yet stiff enough to hold the three-dimensional shape.

3. The breathable bedding element of claim 2, wherein the mesh material is a plastic sheet.

4. The breathable bedding element of claim 3, wherein the mesh material is a perforated plastic sheet.

5. A breathable bedding panel comprising:

an arrangement of breathable bedding elements, each breathable bedding element having a front wall and a rear wall, each wall constructed of a material that allows air to freely pass therethrough, each wall having a length dimension and a height dimension, the back wall having an upper back wall edge and a lower back wall edge and the front wall having an upper front wall edge and a lower front wall edge, wherein the upper back wall edge and upper front wall edge are affixed to each other to form an upper element edge and the lower back wall edge and the lower front wall edge are affixed to each other to form a lower element edge, and wherein the height dimension of the front wall is greater than the height dimension of the back wall, such that the front wall and back wall together form a three-dimensional shape;

wherein the arrangement includes the upper edge of a first breathable bedding element placed adjacent the lower edge of a second breathable bedding element; and a cover that encases the arrangement of the breathable bedding elements;

wherein the three-dimensional shape provides a first resistance against a force applied in a direction transverse to a vertical plane of the back wall and a second resistance against a force is applied in a direction parallel to the back wall, the first resistance being greater than the second resistance and providing a cushioning effect, the second resistance allowing the three-dimensional shape to flatten.

6. The breathable bedding panel of claim 5, wherein the cover has a plurality of pockets, each pocket receiving one or more of the breathable bedding elements.

7. The breathable bedding panel of claim 5, wherein the cover is made of a fabric that is air-permeable.

8. The breathable bedding panel of claim 5, further comprising attachment means for securing the breathable bedding panel to an enclosure.

9. The breathable bedding panel of claim 8, wherein the attachment means are from a group that consists of ties, straps with buckles, straps with hooks, fabric hook-and-loop fasteners, snaps, buttons and buttonholes, and clips.

10. A mattress pad comprising:

an arrangement of breathable bedding elements, each breathable bedding element having a front wall and a rear wall, each wall constructed of a material that allows air to pass freely therethrough, each wall having a length dimension and a height dimension, the back wall having an upper back wall edge and a lower back wall edge and the front wall having an upper front wall edge and a lower front wall edge, wherein the upper back wall edge and upper front wall edge are affixed to each other to form an upper element edge and the lower back wall edge and the lower front wall edge are affixed to each other to form a lower element edge, and wherein the height dimension of the front wall is greater than the height dimension of the back wall, such that the front wall and back wall together form a three-dimensional shape, wherein the three-dimensional shape provides a first resistance against a force applied in a direction transverse to a vertical plane of the back wall and a second resistance against a force is applied in a direction parallel to the back wall, the first resistance being greater than the second resistance and providing a cushioning effect, the second resistance allowing the three-dimensional shape to flatten;

wherein arrangement includes the upper edge of a first breathable bedding element placed adjacent the lower edge of a second breathable bedding element.

11. A mattress comprising:

a plurality of breathable bedding elements, each breathable bedding element having a front wall and a rear wall, each wall constructed of a material that allows air to pass freely therethrough, each wall having a length dimension and a height dimension, the back wall having an upper back wall edge and a lower back wall edge and the front wall having an upper front wall edge and a lower front wall edge, wherein the upper back wall edge and upper front wall edge are affixed to each other to form an upper element edge and the lower back wall edge and the lower front wall edge are affixed to each other to form a lower element edge, and wherein the height dimension of the front wall is greater than the height dimension of the back wall, such that the front wall and back wall together form a three-dimensional shape, wherein the three-dimensional shape provides a first resistance against a force applied in a direction transverse to a vertical plane of the back wall and a second resistance against a force is applied in a direction parallel to the back wall, the first resistance being greater than the second resistance and providing a cushioning effect, the second resistance allowing the three-dimensional shape to flatten;

a cover for receiving the plurality of breathable bedding elements to form a breathable mattress.

12. A crib bumper comprising:

a plurality of breathable bedding elements, each breathable bedding element having a front wall and a rear wall, each wall constructed of a material that allows air to pass freely therethrough, each wall having a length dimension and a height dimension, the back wall having an upper back wall edge and a lower back wall edge and the front wall having an upper front wall edge and a lower front wall edge, wherein the upper back wall edge and upper front wall edge are affixed to each other to form an upper element edge and the lower back wall edge and the lower front wall edge are affixed to each other to form a lower element edge, and wherein the height dimension of the front wall is greater than the height dimension of the back wall, such that the front wall and back wall together form a three-dimensional shape, wherein the three-dimensional shape provides a first resistance against a force applied in a direction transverse to a vertical plane of the back wall and a second resistance against a force is applied in a direction parallel to the back wall, the first resistance being greater than the second resistance and providing a cushioning effect, the second resistance allowing the three-dimensional shape to flatten;

a cover for receiving the plurality of breathable bedding elements to form a breathable panel; and attachment means for securing the breathable panel to a crib.

* * * * *